United States Patent [19]

Wakeland, Jr.

[11] 4,109,887

[45] Aug. 29, 1978

[54] WATERBED RETAINER CAP

[76] Inventor: William E. Wakeland, Jr., 1606 W. Flora St., Stockton, Calif. 95203

[21] Appl. No.: 751,540

[22] Filed: Dec. 16, 1976

[51] Int. Cl.[2] ..... A47B 96/00

[52] U.S. Cl. ..... 248/345.1; 5/52; 5/317 R; 5/370; 5/365

[58] Field of Search ..... 5/317 R, 365, 370, 371, 5/52, 353.11; 248/345.1

[56] References Cited

U.S. PATENT DOCUMENTS

| | | | |
|---|---|---|---|
| 3,358,725 | 12/1967 | Bussard et al. | 248/345.1 |
| 3,393,933 | 7/1968 | Cornelius | 248/345.1 |
| 3,840,921 | 10/1974 | Labianco | 5/371 |
| 3,842,456 | 10/1974 | Bronstien, Jr | 248/345.1 |
| 3,869,106 | 3/1975 | Gregou | 248/345.1 |
| 3,973,282 | 8/1976 | May | 5/370 |

*Primary Examiner*—Casmir A. Nunberg
*Attorney, Agent, or Firm*—Mark C. Jacobs

[57] ABSTRACT

A rail cap for a water bed frame rail comprising a generally U-shaped foam structure with a passageway at the open end of the U, to receive the rail and a pressure inhibiting member associated therewith to retain the cap on the rail.

18 Claims, 20 Drawing Figures

WATERBED RETAINER CAP

BACKGROUND OF THE INVENTION

The present invention relates to waterbeds and more particularly to a retainer cap for use on the side rails and and foot rails.

Today water beds are in widespread use, in hotels, homes and motels. The frames employed to hold the water bag or mattress, include upstanding side and head and foot walls secured to a bottom wall. For the most part, such frames are made of 2 inch × 10 inch lumber. Such frames are manufactured around the country by different companies, many of whom are mentioned in Waterbed Retailer, a trade publication.

Waterbeds and waterbed frames are also known to the patent literature. Thus mention can be made of Weinstein et al U.S. Pat. No. 3,689,949; Hall U.S. Pat. No. 3,585,356 assigned to Innerspace Environments, Inc. and May, U.S. Pat. No. 3,838,470.

All of the frames of the prior art share one common difficulty, in that the edge of the bed unit is wood, and thus uncomfortable to sit on. The wood also makes getting into and out of the bed quite difficult. Attempts have been made to overcome this discomfort by padding the rail. However when this is done, other problems arise. When the liner is placed over the side rail and the upholstered wooden cap is forced over the liner causing a pressure or friction fit to hold the liner and cap in position, the liner tends to stretch and tear. The liner becomes nonuseable after caps are removed for any reason. This stretching and tearing of the liner by the cap's pressure can be eliminated by nailing a wooden strip to the side wall, just below the cap's normal position, to hold the liner in a vertical position as is siderail in a vertical position. However, there is a danger of nails, tacks, screws or other fastening devices becoming dislodged and causing failure in the main water mattress compartment. This is a problem well understood by the art.

The art then turned in another direction, namely to the use of rail caps. This would allow for conventional manufacture, but would also provide comfort. Such caps are U-shaped members made of wood, and covered on the outer surface with a fabric such as leather or vinyl. The inside dimension between the parallel portions is substantially equal to or slightly larger than the thckness of the side rail such that upon insertion upon the side rail, there is a friction fit such that the cap is retained in place. In actuality, however, the natural movement of the mattress tends to force the side and other rail caps upward and out of place, unless they are secured by the use of nails or screws which are placed through the side of the rail cap or end cap into the up-standing side or end rail to prevent removal from poor fit or water pressure. The cap's decorative covering must be punctured and the presence of screws or nail heads creates a possibility of puncture to the main water mattress, or holes in the liner if such is placed under cap member. Indeed, possible injury to one's hands may occur when inserting bedding beneath the cap from the screws or nail heads. Also due to close tolerances, it is difficult for the homeowner to insert the liner between the cap and rail without stretching or tearing the protective liner to prevent should one desire its relocation.

The present invention is seen to overcome the foregoing and other advantages of prior art water bed frame constructions.

SUMMARY OF THE INVENTION

The instant invention is seen to encompass a new type of rail cap which overcomes the cited disadvantages of the prior art.

It is the primary object therefore to provide a rail cap which will remain in place securely until the user decides to remove the cap.

It is another object to provide a cap which can be removed at will without damage to the cap, the liner, the mattress, or the water bed frame.

Another object is to provide a rail cap which will not be raised out of place by the pressure of the water mattress in its natural state or in an induced movement state.

Still another object is to provide an esthetic cap which is also comfortable to sit on, yet overcomes the previous problems aforementioned.

In general it is seen that the instant invention comprises a generally U-shaped foam structure with a passageway at the open end of the U configured to receive a retainer of corresponding configuration, though slightly smaller, which retainer is secured to the upstanding rails of the waterbed frame. The rail cap and the retainer are generally coextensive in length, and are intended to be of a length equal to that of the upstanding rail.

It is seen therefore that other objects of the invention will in part be obvious and will in part appear hereinafter.

The invention accordingly comprises the device possessing the construction, and combination of parts which are exemplified in the following detailed disclosure, and the scope of the application of which will be indicated in the appended claims.

BRIEF DESCRIPTION OF THE DRAWINGS

For a fuller understanding of the nature and objects of the invention, reference should be made to the following detailed description taken in connection with the accompanying drawings, wherein.

In the figures where the same part appears a plurality of times, like numbers will be utilized to indicate like parts.

It is seen that in FIGS. 1 through 6 that the retainer member is not drawn to scale relating to the cap and the rail in order, to better illustrate the invention. Thus FIGS. 1*a*, 2*a*, 3*a*, 4*a*, 5*a*, and 6*a* better approximate the relative relationship between the sizes of the retainer, the rail and the cap.

FIGS. 1*a* through 6*a* correspond to the embodiments and the Figures depicting said embodiments in FIGS. 1 through 6 inclusive respectively.

Figure 14:
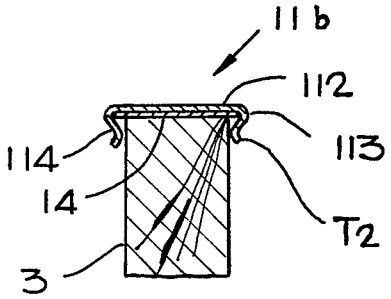
FIG. 14 depicts a sectional view without the cap of yet another insert configuration, shown in engagement with a retainer on a rail.

Thus in one embodiment that was prepared for use with a standard 1 inch thick side rail, the overall elevation of the foam rubber cap, excluding covering material was 100 mm; the elevation of the central vertical passage was 40 mm, and the thickness of the retainer such as illustrated in FIG. 14 was about ¼ inch. No criticality is seen to be in any of these dimensions, and it is within the skill of the art to prepare a retainer and cap dimensioned to carry out the purpose of the invention while being esthetically pleasing.

DESCRIPTION OF THE PREFERRED EMBODIMENTS OF THE INVENTION

Figure 1:
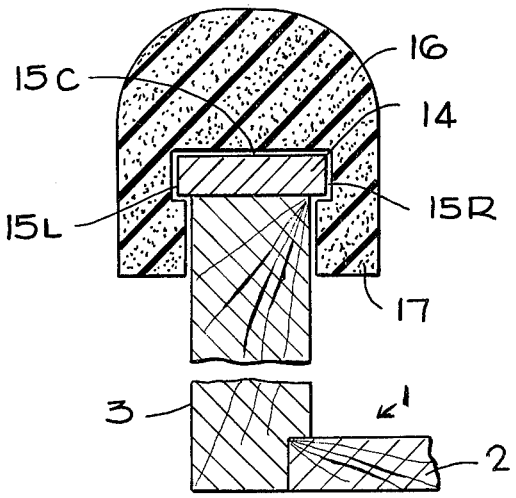
FIG. 1 is a fragmentary sectional view vertically through a waterbed frame and water mattress, showing a retainer strip and rail cap of one embodiment of this invention.
Figure 2:
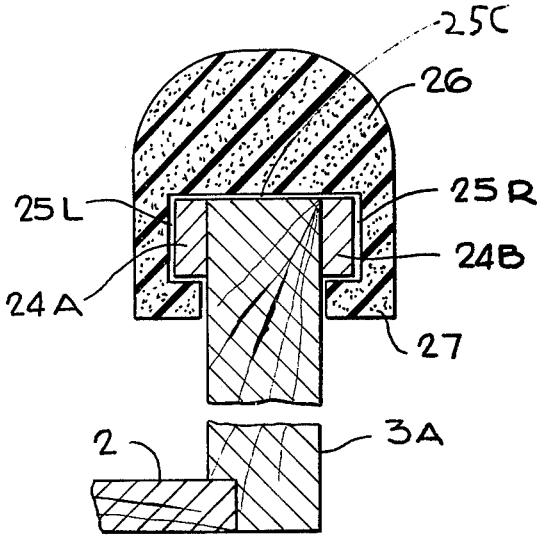
FIG. 2 is a sectional view of part of a waterbed frame, depicting part of the base, one side wall, and another configuration of retainer and rail cap, wherein the retainers are mounted on the sides of the rail.

Referring now to FIGS. 1 & 2 the water bed frame 1 is shown as comprising an upstanding outer wall pair 3, 3*a*, said pair of walls being vertical and parallel to each other. Each side wall 3, 3*a*, is shown secured to a bottom wall 2. A horizontal retainer 14 is secured to the top of the side wall and said retainer 14 extends both inwardly and outwardly therefrom on both side walls 3, 3*a*, and optionally on the foot and head boards, not shown in this figure. In the configuration of this figure, bottom wall 2 rests directly on the floor and so no other supports are depicted. An optional pedestal, not shown, may be employed with the frame. Suffice it to say that since the invention is seen to be an addition to the basic waterbed frame, no further discussion as to legs and pedestals is required at this time. A generally inverted U-shaped foam member 16 is provided with a central vertical passage 15C, often rectangularly configured, and two adjacent side notches, also rectangularly configured and denoted as 15L and 15R. The altitude of 15L & 15R is less than the altitude of 15C and less than the width of 15R or L, or equal thereto for best results. In the preferred embodiment, retainer 15 is about 2 inches wide and about ⅛th to ½ inch thick. The top edge of passage 15C is in the same plane as the top edge of notches 15R & L. As is seen, there is a combined opening 15LCR formed from the passage 15C and the two notches, 15L & R. The combined opening substantially equals the the combination of the retainer and the side wall dimensionally such that when the cap is mounted on the side rail, a snug fit occurs.

In use, the edge of the water mattress 4 fits into and under the cove 17. The bedding not shown also fits down in the cove and is retained in place. The pressure of the water bed mattress as shown by the force lines applies pressure to the foam to keep it frictionally tight against side wall 3, and 3*a*. Liner 81 is placed between rail 3 & cove portion 17 of channel member 16 and continues upward beyond the retainer causing liner 18 to become contoured and sandwiched between retainer 14 and cove 17 of channel member 16 creating a natural securing of the liner 18 due to resistance to removal because of the liner's 18 assumed position. This functions also as a superior method of holding the liner in the highest possible position and thus allowing maximum amount of safety should the water mattress fail. It is seen that the pressure applied by the weight of the water is enhanced by the presence of people lying on the mattress as the force is increased against the channel 16 to hold it better in place. Unlike prior caps, the presence of the retainer 14 prevents the pressure of the mattress from forcing the cap upward & off the side rail 3. Thus the notches act as a pressure inhibiting means.

In FIG. 2 there is shown part of a water bed frame, similar to the one shown in FIG. 1. The prime distinction is the fact that the retainer consists of two rectangular members secured one per side of the side rail 3A, and designated 24*a* & 24*b*. The narrower dimension is positioned horizontally, and the wider dimension is positioned vertically. The top edge of each retainer 24 is set in the same plane with and coextensive with the top surface of side rail 3A. Cap 26 has a central passage 25C, rectangular in shape and similar to that of 15C. Notches 25L and 25R are seen to be rectangular in shape and adapted to accommodate retainers 24*a* and 24*b*. Notches 25L and 25R are seen to be no more than about ½ inch wide. The altitude of the uncut foam defining the cove should not be less than about ½ inch for 27 in order to maintain the retainer sturdily in place in the notch 25.

Figure 3:
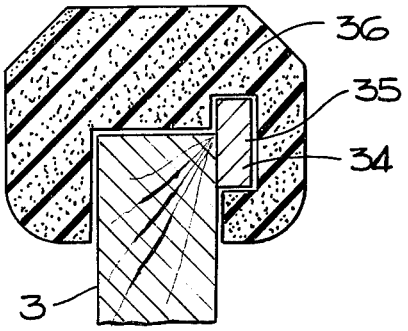
FIG. 3 is a similar view as FIG. 2, but only one retainer is employed and it only partially abuts the side wall.
Figure 4:
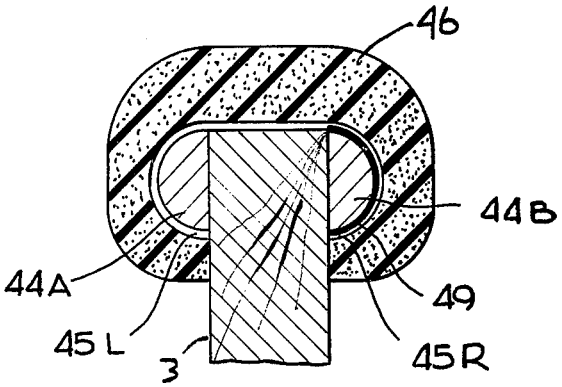
FIGS. 4 and 5 are views similar to FIG. 3 but depicting different embodiments of the invention.
Figure 5:
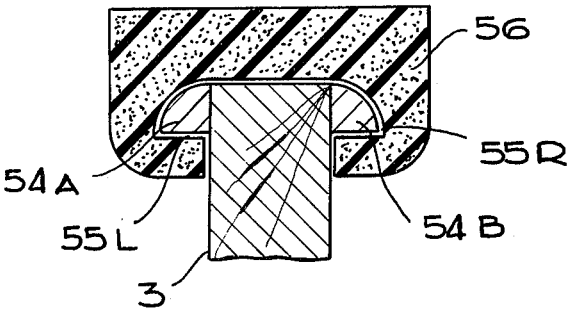

FIGS. 3, 4, and 5 depict different configurations of caps 36, 46, & 56 and different configurations of retainers, 34, 44*a* & *b*, and 54*a* and 54*b*. The passage portion of all of the caps is the same, of a size to receive a standard side rail 3. Each notch 35, 45L & R, and 55L and R are adapted to receive its respectively similarly configured retainer, though slightly different in size larger to receive the retainer and hold it therein. The retainers of FIGS. 3, 4, & 5 respectively are seen to be a rectangle that partially abuts side rail 3, two half round retainers and two quarter round retainers. The notches of the respective caps are seen to accomodate the particular retainer that is keyed in shape thereto.

No criticality is attached to the shape of either the retainer or the notches. As such those shown are merely exemplary. It is also within the scope of the invention to mix right and left retainer shapes, and right and left notches. The only requirement is that the notches employed be keyed to the shape of the retainer to be employed therewith and be slightly larger dimensionally to receive same.

It is seen that the caps of FIGS. 1 and 2 have curved top surfaces, while that of FIG. 3 is of angled corner figuration and that of 4 similar to FIG. 1 and that of FIG. 5 of right angled configuration. Again no criticality is attached to the geometry of the top surface top edge of the cap.

Figure 6:
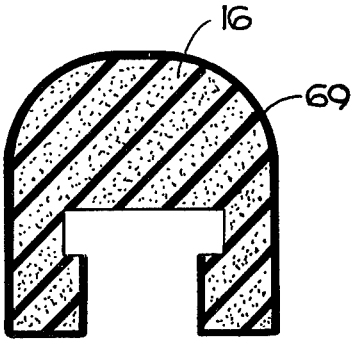
FIG. 6 depicts a cap which has a suitable covering for esthetic purposes thereupon.
Figure 1A:
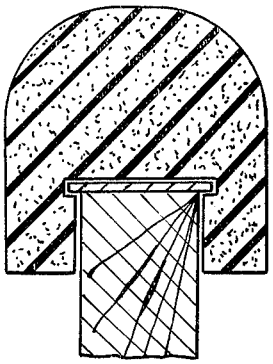
Figure 2A:
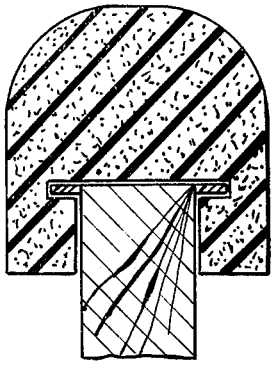
Figure 3A:
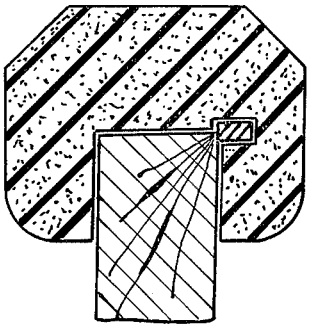
Figure 4A:
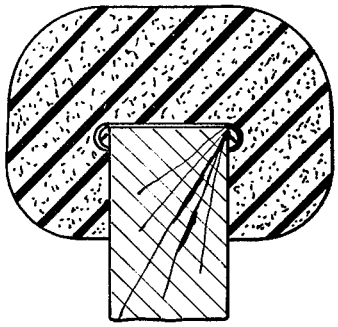
Figure 5A:
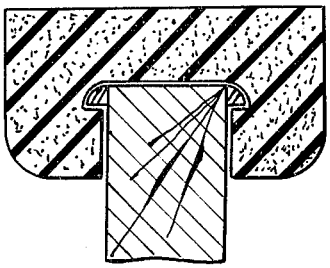
Figure 6A:
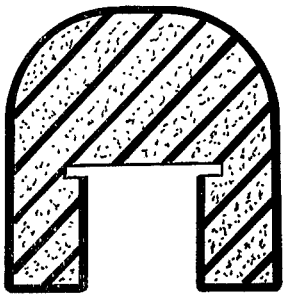

FIG. 6 shows the cap of FIG. 1 with a vinyl or leather or fabric covering 69 thereupon to enhance the appearance of the cap.

Figure 7:
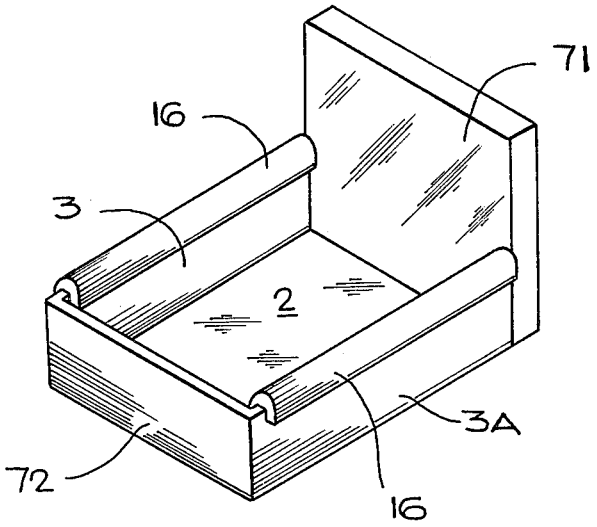
FIG. 7 is a perspective view of a water bed frame without a mattress, but showing rail caps according to this invention positioned on the two side rails.

FIG. 7 shows a total waterbed frame in perspective view. Items 3 and 3*a* are the side rails, in upstanding position, secured to at each end a foot board 72 and a head board 71; thus forming a rectangular frame which in turn is secured to a bottom member 2. Retainers are not visible in this view. Rail caps 16 are seen to be secured in place on both of said side rails 3 and 3*a*, and are of a length equal to the length of the side rails. A footboard rail cap may be employed in like manner, but is not shown in the Figure. For comfort and esthetic appeal, caps 3 and 3*a* are usually employed along the entire length of the side rail, but such is not required. As indicated above, the top surface geometry, shown rounded in this figure is chosen at the pleasure of the cap user. Also shown in FIG. 4 is a rough coated layer 49, secured by adhesion to 44*b*. Such a layer, for example sand paper glued to the retainer 44*b* is intended to increase the friction in the fit of the retainer with the cap.

Figure 8:
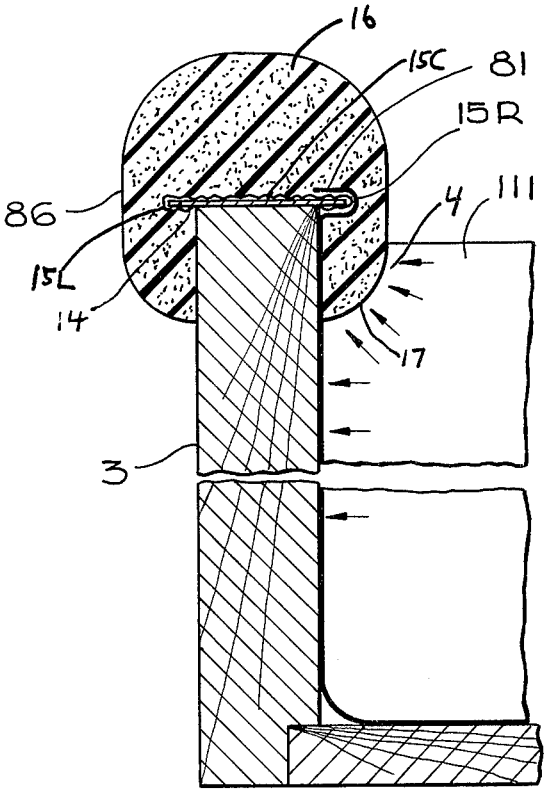
FIG. 8 is a fragmentary sectional view vertically through a water bed frame and water mattress, showing another embodiment of rail cap of this invention.

In the alternate embodiment of FIG. 8 there is provided a railcap which is of a generally inverted U-shaped configuration 16. The foam member 16 is provided with a central vertical passage 15C, usually rectangularly configured and two side notches 15L and 15R adjacent respectively to and communicating with 15C, as in FIG. 1, and being rectangularly configured. Wedged or otherwise secured by member 16 is a pressure inhibiting member constituting a liner 81, which is provided partially around the retainer receiving means 15R. The dimensions of the various parts have been recited previously in conjunction with FIG. 1.

Drape 81 is intended to be of a size such that when secured in place, a portion hangs pendant below the opening 15C.

Figure 9:
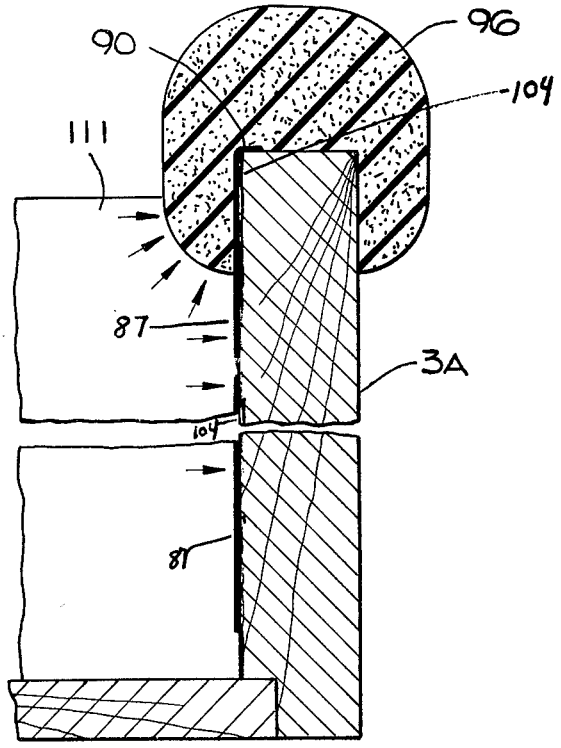
FIG. 9 is an alternate form of the embodiment of FIG. 8.

In the alternate form in FIG. 9, there are no side notches 15R or 15L, only the central passage 15C. In this embodiment, the drape 87 is cemented or otherwise secured to the inside surface of cap 96 at the position denoted 90 in FIG. 9. If desired the drape 87 can be wrapped around as shown or adhered to one side of the passage wall as may be desired.

In conjunction with the embodiments of FIG. 9 there may be employed a friction creating means 104, which can be sandpaper or another friction providing element to help retain the drape in alignment parallel to the rail. Such friction creating means 104 is secured not to the cap, but to the inside vertical surface of the rail 3. Whereby as the fabric or drape 87 tends to move slightly due to pressure caused by persons lying on the mattress, it abuts or rubs against the sandpaper 104 and is impeded from moving upwardly.

Another embodiment of this invention employs a different retaining means in so far as the portion secured to the rail cap is concerned. It is seen from FIG. 10 that retainer 14 similar to that utilized in the embodiment of FIG. 1 is secured to the top surface of the side or end rail of the water bed frame. Side rail 3 has shown mounted thereon retainer 14 dimensionally slightly larger, such as to protrude beyond the thickness of the rail on both sides of said rail. Further details on retainer 14 and rail 3 need not be recited herein in view of the discussion previously set forth above. In this embodiment, there is shown adhesed to the vertical inside walls of cap 17 flexible detent members 103 and 105. Such plastic members are sized as to occupy at least a portion of the altitude of the interior wall of cap 17. Optionally, there may be employed plastic member 102 interposed horizontally between flexible detent members 103 and 105 such as to form a U-shaped channel. It is also within the scope of the invention to employ a one-piece U-shaped channel comprising 105, 102 and 103 secured right angularly to form a one-piece U-shaped member 100. Such U-shaped channel is sized to be co-exstensive with the dimension of the passageway of cap 17 such as to be securely adhesed to the walls such as to form a secure reinforced passageway. Shown adhered to each of 103 and 105 is a plurality of flexible upwardly pendant pawl-like detents 101. Each of said detents is capable of flexing inwardly toward said members 103 and 105 respectively. Said pawl-like detents are capable of flex when said retainer 14 is pushed vertically against same, such that when a downward force is applied to 14 the retainer, is held in place on the pawl-like detents such as to form a secure engagement between the rail cap and the rail. In order to remove said rail cap, it is only necessary to flex the bottom portion on either side of said cap to cause the insert to release from said retainer by being moved upwardly and outwardly. A plurality of pawl-like detents are suggested, since those not in use to retain the retainer 14 can serve to create a frictional fit between said cap and said rail. Thus it is to be seen that in operation, when said rail cap 17 is pushed downwardly upon and over said retainer, that each of said pawls 101 will be caused to flex upwardly and inwardly such as to allow the cap 17 to be pushed all the way down until physical contact is made between member 102, or if not employed, the horizontal surface of the foam of said cap 17, with the top surface of retainer 14 such that retainer 14 is held in removable engagement with flexible pawl-like detents 101. This engagement comprises naturally only one of said detents on either side of said retainer 14. It is within the skill of the art to design and to determine suitable dimensions for the pawl-like detents and the suitable spacing between each of said same for the manufacture of parts 103 and 105.

Figure 12:
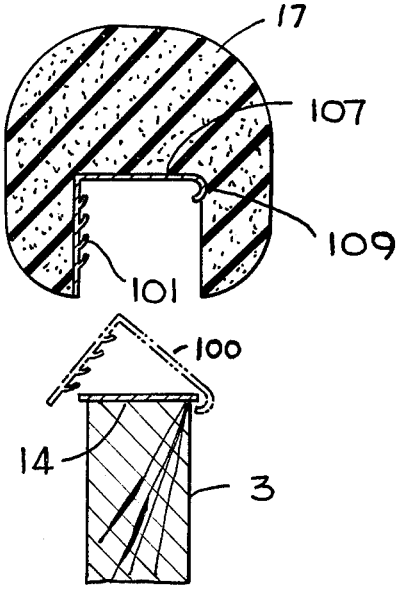
FIG. 12 is a fragmentary sectional view of a rail cap and rail retainer wherein an inverted L shaped insert terminating in a c-hook is shown secured to the cap. The insert above is shown in phantom to better illustrate its operation with respect to attachment and detachment of the rail cap.

Still another retainer engagement means is that shown in FIG. 12. Here, a standard retainer 14 as shown in FIG. 1 is employed. This retainer protrudes slightly on both sides of said rail for the full length of the rail preferably. In the cap of this embodiment, there is shown a 90° oriented generally L-shaped member 107, which terminates on its horizontal end in a inwardly turning hook member 109 and which has on its vertical extension a plurality of detent members 101. This hook shaped inwardly extending portion 109 is capable of releasably engaging retainer 14 on one side thereof, while one of the plurality of detents 101 engages releasably the other extending portion of retainer 14. While the hook is shown to be on the right hand side of said cap as one faces same, needless to say it can be utilized in a mirror reverse position. Here, too, a plurality of detents are used such as those that are employed for retaining retainer 14, may form a tighter friction fit between themselves and the rail cap 17 than would be possible if only one detent would be employed.

Figure 10:
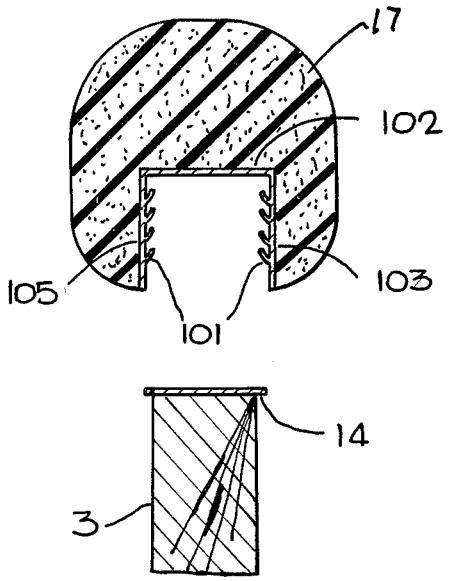
FIG. 10 is an elevational view of another embodiment of this invention wherein the retaining means comprises a retainer strip 14 and a flexible detent system adhesed to the inner wall of the rail cap.

However, it is to be seen that for both the embodiment of FIGS. 10 and 12, that it is only necessary to provide one detent for actual engagement of the retainer 14. Needless to say that in FIG. 10, one detent means one per side while in FIG. 12 only one detent is needed in that the hook 109 acts in similar fashion for retaining purposes as do the detents 101.

In FIG. 12 there is also shown a phantom 107, to indicate the method of deploying 107 the hook, such as to cause it to engage the retainer. It is also readily seen how the detent will engage the opposite side of said retainer.

Figure 11:
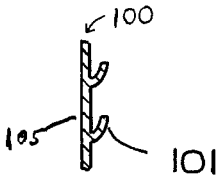
FIG. 11 is a perspective close up view of a flexible detent member, 103, shown in fragment.

In FIG. 11, there is shown a closeup of part of an insert 100 consisting of detent member 105 having a plurality of ribs or detents 101 mounted thereon.

Figure 13:
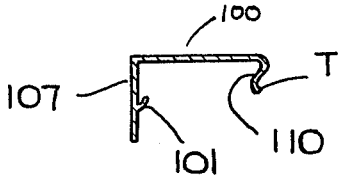
FIG. 13 depicts an alternate inverted L shape insert terminating in a mirror image s-hook.

FIG. 13 depicts an alternate insert 100 comprising portion 107 with a terminal section of a mirror image S on its horizontal end. The advantage of the S hook over the C hook is seen in the ease of removal of the cap from the retainer tab T on terminal section 110 is easily grasped by the operator for flexural removal of the cap from the retainer 14. Shown secured to and forming a part of insert 100 is one flexible detent 101 mounted on L portion 107. The use of more than one detent is within the scope of the invention.

In FIG. 14 there is shown only an alternate insert 116 for adhesion in a rail cap not shown comprising a flat horizontal section 112 having an S shaped pendant portion 114 disposed vertically on the left side thereof and a mirror S 113 disposed vertically on the right side thereof. $T_2$ is a tab area which is part of 113 and which is intended to be grasped for removal of the cap from the rail.

FIG. 13 depicts a preferred form of the retainer engagement means of FIG. 12. Here instead of merely a C-hook to engage the retainer 14, an S-hook 110 is employed. By having the pendant addition, or tab T, added to the engaging portion, one need merely grasp tab T of 110 to release the releasably engageable S-hook 110 from retainer 114. Whereas with the C-hook 109 one must flex the horizontal portion 107 slightly or at least flex 109 slightly by use of the fingertips to disengage 109.

The generally L-shaped portion 107 and the hooks 109 and 110 of FIGS. 12 and 13 can be made as separate segments which are bonded together but preferably they are extruded as one piece of plastic or metal including the detents (ribs) 101.

It is believed that the inherent shape of the S-hook 110 with a surface thereof being in contact with the rail, will lessen the advantage of having a plurality of detents or ribs on the side opposite the hook, for a better frictional engagement of the side rail, and so only one such rib 101 is shown in FIG. 13 though more than one may be present.

FIG. 14 depicts yet another embodiment 11, of a retainer releasably engageable engagement means. Here, a flat horizontal portion 112 is adhered to the foam cap, not shown, as is the case with all of the previously discussed horizontal portions of the several rail caps previously disclosed. Abutting the horizontal portion are S-hooks 113, one on each side. The hooks are disposed such that the terminal edge abuts the edge of the horizontal portion 112, with the balance of hook 113 pending downwardly therefrom as shown in the Figure. Hooks 113 are preferably manufactured as an integral unit with horizontal portion 112. As may have been mentioned above, the hooks 113 are not secured to the inside of the rail cap, not shown.

In operation, the retainer engaging means **11*b*, now placed in position in the cap 17, is set down directly over a retainer 14. A downward pressure is applied, on the cap 17 to cause the arcuate sections 114 previously in contact with the rail to move sidewardly, and thereby to spread out over the edges of the retainer. Once the retainer has been cleared, the arcuate sections 114 move inwardly beneath the edges of the retainer, and preferably they move until contact is made with the rail 3**, if the hooks have been configured to permit same to transpire.

Thumb or finger placement on tabs $T_2$ will cause the hooks to disengage from the retainer 14.

Needless to say, caps manufactured according to FIGS. 10, 12, 13 and 14 can be recovered over in like manner to the embodiment of FIG. 6.

Turning now to the construction of the cap, it is seen that any flexible foam material may be employed. The outer edge of same may be of a closed cell or an open cell nature. While a flexible polyurethane foam is preferred, any expandible foam product may be employed. The higher the density of the foam, the better the structural rigidity of the cap. A flexible foam is preferred to a rigid foam for several reasons. Firstly, the flexible foam is easier to engage with the retainer. Force will not be required to push the cap onto the rail and retainer(s) during the course of travel along the passage vertically until the notches are reached. A flexible foam cap can be flexed outwardly to envelop the retainer. Suitable foam products inside foamed polystyrene, and foam rubber as well as urethane. Flexible foam urethanes suitable for the caps herein are sold by United Foam of Hayward Calif., as Foams, 2108, 2060, 2072 and 2188 among others. Another source of foam is the Mobay Chemical Company.

An enhanced appearance of the cap of foam can be achieved by spraying the foam structure with Hypalon® rubber, with or without coloring matter therein. In addition, as shown in FIG. 6 a vinyl, fabric, or leather covering can be adhered or sewn to the cap. These may have designs thereon as desired.

Generally it will be seen that the altitude of the caps of this invention will range from about 3 inches to 5 inches in height, with 3.5 inches being preferred; and about 3 inches to 5 inches in width with about 3.5 inches being preferred. The width of the passage is slightly over $1\frac{5}{8}$ inches and is designed to accommodate the industry's standard $1\frac{5}{8}$ inch wide rail, which is generally about $1\frac{5}{8}$ inches. The altitude of the passage should be less than half the altitude of the cap. These dimensions are intended to handle industry standard rails as they exist today. Needless to say, these figures are not intended to be limiting.

The retainers discussed above may be of any suitable material such as molded plastic, metal or wood. They may be attached to the side rail 3 and the foot and head rails when employed by any suitable manner such as glue, screws, and the like. When secured, the retainer must be in a horizontal plane along the entire length of the retainer. If not, then the cap which is adapted to receive same in a horizontal manner along its own entire length will not mate therewith.

If desired, there may be employed mitered or unmitered corners at the junction of the footrail & siderail when both are made of wood. Either is within the scope of this invention Generally butted edges will be employed.

In using the embodiments of the invention as set forth in FIG. 9, the drape material 87 which is secured to the rail cap bearing the number 96, is placed along the upstanding siderail. The cap is then placed on the rail with the drape portion which is pendant therefrom placed on the inside of the bed rail. The drape material may comprise any type of fabric that is water proof and durable, which is flexible and which does not tear easily. Mention may be made to canvas, chintz, polyvinyl chloride, nylon and the like. When the mattress 111 is filled, pressure is exerted as shown by the arrows (unnumbered) in FIGS. 8 and 9, against the upstanding bed rail 3, to hold the liner in place in 8 and also against 3A in FIG. 9 for the drape.

The embodiment of FIG. 8 which employs the retainer means of this invention would seem to have more holding power than the version of FIG. 9 without the retaining means.

The drape is required to hang down sufficiently enough such as to be interposed between the rail and the mattress, to allow the water pressure against it to be great enough to resist the natural upward force of the water mattress against the cap due to the natural movement of the body upon the mattress.

Naturally care should be taken not to catch the drape up in the recess of the cap when applying the cap. If so, the water pressure of the mattress will not be able to act against it to hold the cap and drape in the desired location in the rail.

Installation of the cap onto the rail is quite simple. The cove portion of the channel is flexed to enlarge the passage such that the cap can be easily placed down over the previously presecured retainer on the rail. The flexing is released and a tight fit of the cap over the rail and retainer is seen to transpire.

While the embodiments of the water bed shown herein are seen to be rectangular, it is within the scope of the invention to employ retainers and caps on circular and heartshaped and and other configuration of water bed contemplated. The disposition of the cap on the retainer secured to the rails would be in like fashion of applying a downward force of the cap over the retainer.

One major advantage of the instant new cap system is that it can be employed with preexistant water bed frames, merely by securing retainers to the rails and disposing the caps thereupon.

It is further seen to be within the scope of the invention to employ as the geometry of the lower outside edges of the cap either the hard corner as in FIGS. 1 and 2 or the rounded edges as in FIGS. 3, 4, and 5 or other desired appearances.

While the discussion has centered upon an engaging insert that is configured in an ⌐ shape, obviously such insert may be mirror imaged and configured ¬. As such, in both the specification and the claims, both shapes are to be understood when the one symbol ⌐ is employed.

It is seen that there has been provided herein a foam rail cap which works in combination with a plurality of retaining mechanisms, each of which has been devised to keep the cap on the rail when subjected to pressure upwardly and pressure sidewardly.

Thus in the embodiments of FIGS. 1, 2, 3, 4 and 5 there are provided retainer members configured to match a corresponding cut away area of the cap.

In the versions of FIGS. 8 and 9 a retaining mechanism is also employed which in FIG. 8 is a retainer member employed in conjunction with the liner, while in FIG. 9's embodiment only a drape 87 is employed optionally with a friction creating device 104, but without a retainer receiving notch(es).

Whereas in FIG. 10, 12, 13 & 14 embodiments, there is no retainer receiving means, ie. a channel used in combination with one or more notches. Here a channel has secured therein an insert 100, except as noted in FIG. 14 as 116. The insert may be of metal or plastic and is used to secure the cap 17 to the retainer 14. The useage for engagement and disengagement is readily seen from FIG. 12 wherein insert 100 is shown in phantom at the commencement of engagement [Insert not shown secured to channel walls].

It is seen therefore that the retainer receiving means or the channel with an insert therein will act as a pressure inhibiting member to help retain the cap on the rail. The drape of the FIG. 9 embodiment serves a like function, as will the use of the bed liner as depicted in the FIG. 8 embodiment.

It is within the scope of this invention to employ the the retainer receiving means of FIG. 3 in conjunction with the drape of FIG. 9's embodiment to have a combination pressure inhibiting member.

While there have been shown and described hereinabove what are considered to be the preferred embodiments of the present invention, it will be obvious to those of oridinary skill in the art that various changes and modifications may be made therein without departing from the spirit of the invention as defined in the appended claims.

What is claimed is:

1. A railcap for a waterbed frame rail comprising an inverted generally U-shaped piece foam member having both a central passage at the open end thereof to receive a waterbed frame rail of similar configuration therein, and of a size slightly larger than said rail, and a pressure inhibiting member selected from the group consisting of retainer receiving means, a drape secured at least to one wall of the inside of said cap defining said central passage, and combinations thereof, and an engaging insert.

2. The rail cap of claim 1 wherein the U-shaped foam member has a covering thereon.

3. The rail cap of claim 1 wherein said pressure inhibiting member is one or more notches in said cap that communicates with said central passage thus forming a retainer receiving means.

4. A rail cap of claim 1 wherein said pressure inhibiting member is a drape secured at least to one wall of the inside of said cap defining said central passage.

5. The rail cap of claim 1 wherein the pressure inhibiting member comprises a combination of one or more notches and a liner.

6. The rail cap of claim 1 wherein the pressure inhibiting member comprises two notches that communicate with the central passage, one on each side thereof.

7. In combination, a water bed frame rail and a one piece foam inverted U-shaped rail cap having a drape secured thereto and pendant therefrom, said foam rail cap adapted to engage said rail, with the secured portion of said drape being interposed therebetween.

8. In a frame for a water bed water mattress, the combination of:

a. a mattress confining, generally vertical side wall having a cap retaining means secured to the top of said wall, and b. a one-piece inverted U-shaped foam rail cap engageable with both said rail and said retaining means further including a drape secured to said foam rail cap and pendant therefrom.

9. The rail cap of claim 1 wherein said pressure inhibiting member is an engaging insert.

10. The rail cap of claim 9 wherein said U-shaped foam member's central passageway's walls has adhesive therein an insert for engaging a retainer mounted on a waterbed frame rail.

11. The rail cap of claim 10 wherein said insert is inverted L shaped configured, with a vertically pendant terminal portion secured to the end of the horizontal section of said inverted L shape.

12. The rail cap of claim 11 wherein said terminates in a reverse C-hook.

13. The rail cap of claim 11 wherein said terminates in a mirror image S-hook.

14. The rail cap of claim 12 wherein one or more flexible detents are secured to the inner vertical side of the inverted L shape not secured to the foam member.

15. The rail cap of claim 13 wherein one or more flexible detents are secured to the inner vertical side of the inverted L shape not secured to the foam member.

16. The rail cap of claim 9 wherein said insert comprises a pair of vertical members having one or more flexible detents thereon on one side thereof, each of said vertical members being secured to one of the two inside vertical walls of the U-shaped foam member, on their non-detent containing sides.

17. The rail cap of claim 9 wherein said engaging insert is a horizontal member terminating in a pendant S hook on the right side thereof.

18. In a frame for a water bed water mattress, the combination of:

a. a mattress confining, generally vertical side wall having a cap retaining means secured to the top of said wall, and b. a one-piece inverted U-shaped foam rail cap engageable with both said rail and said retaining means further including an insert C, secured within said U-shaped foam rail cap for engaging said cap retaining means.

* * * * *